US010161299B2

(12) United States Patent
Zhang

(10) Patent No.: US 10,161,299 B2
(45) Date of Patent: Dec. 25, 2018

(54) FIXED-RAIL ROTOR PUMP AND FIXED-RAIL ROTOR PUMP COMBINED SUPERCHARGING INTERNAL-COMBUSTION ENGINE

(71) Applicant: Yi Zhang, Qingdao (CN)

(72) Inventor: Yi Zhang, Qingdao (CN)

( * ) Notice: Subject to any disclaimer, the term of this patent is extended or adjusted under 35 U.S.C. 154(b) by 307 days.

(21) Appl. No.: 14/906,884

(22) PCT Filed: Jul. 24, 2014

(86) PCT No.: PCT/CN2014/000700
§ 371 (c)(1),
(2) Date: Jan. 21, 2016

(87) PCT Pub. No.: WO2015/010446
PCT Pub. Date: Jan. 29, 2015

(65) Prior Publication Data

US 2016/0153348 A1 Jun. 2, 2016

(30) Foreign Application Priority Data

Jul. 24, 2013 (CN) ..... 2013 1 0314677
Jul. 24, 2013 (CN) ..... 2013 1 0314697

(51) Int. Cl.
*F02B 33/36* (2006.01)
*F04C 27/00* (2006.01)
(Continued)

(52) U.S. Cl.
CPC ..... *F02B 33/36* (2013.01); *F01C 1/44* (2013.01); *F02B 55/02* (2013.01); *F02B 55/08* (2013.01);
(Continued)

(58) Field of Classification Search
CPC ..... F01C 1/44; F04C 18/44; F04C 2/44
See application file for complete search history.

(56) References Cited

U.S. PATENT DOCUMENTS 6,637,383 B2 * 10/2003 Al-Hawaj ..... F01C 1/44 123/43 C
6,668,767 B1 * 12/2003 Sanchez Talero ..... F01C 1/44 123/18 R
(Continued)

FOREIGN PATENT DOCUMENTS

CN 1129288 A 8/1996
CN 2266048 Y 10/1997
(Continued)

OTHER PUBLICATIONS

International Search Report (PCT/ISA/210) dated Oct. 10, 2014, by the State Intellectual Property Office of China as the International Searching Authority for corresponding International Application No. PCT/CN2014/000700.
(Continued)

*Primary Examiner* — Mary A Davis
(74) *Attorney, Agent, or Firm* — Gokalp Bayramoglu

(57) ABSTRACT

A fixed-rail rotor pump and fixed-rail rotor pump combined supercharging internal combustion engine are described. In the fixed-rail rotor pump, a rotor shaft runs through a rotor; the rotor is internally tangent to the inner wall of the cylinder; the inner side of at least one side of a cylinder-end cover is fixed with a convex fixed-rail disposed concentrically with the cylinder; the rotor runs through the cylinder end cover and the fixed-rail; a piston is provided along the external periphery of the rotor and is rotatably connected to the rotor via a rotating shaft of the piston; the rotor is provided with a piston comprises a top arc surface, a bottom arc surface the three angels of the piston constitute an equilateral triangle; the top angle of the piston keeps contact with the inner wall of the cylinder; the bottom arc surface of the piston is externally tangent to the outer peripheral
(Continued)

surface of the fixed-rail; the piston moves in a curved path around the fixed-rail.

18 Claims, 7 Drawing Sheets

(51) Int. Cl.

| | |
|---|---|
| ***F04C 2/44*** | (2006.01) |
| ***F02B 55/08*** | (2006.01) |
| ***F01C 1/44*** | (2006.01) |
| ***F04C 15/00*** | (2006.01) |
| ***F02B 55/02*** | (2006.01) |
| ***F02B 55/14*** | (2006.01) |
| ***F04C 18/44*** | (2006.01) |
| ***F01C 21/06*** | (2006.01) |
| *F01C 21/08* | (2006.01) |

(52) U.S. Cl.
CPC ..... *F02B 55/14* (2013.01); *F04C 2/44* (2013.01); *F04C 15/0003* (2013.01); *F04C 18/44* (2013.01); *F04C 27/00* (2013.01); *F01C 21/08* (2013.01); *F04C 27/001* (2013.01)

(56) References Cited

U.S. PATENT DOCUMENTS

| | | | | |
|---|---|---|---|---|
| 9,482,092 | B2 * | 11/2016 | Ulaganathan | F01C 1/44 |
| 9,631,621 | B2 * | 4/2017 | Yamaguchi | F04C 18/44 |
| 2005/0053509 | A1 | 3/2005 | Liposcak | |
| 2006/0130803 | A1 * | 6/2006 | Tseng | F01C 1/44<br>123/241 |

FOREIGN PATENT DOCUMENTS

| | | | | |
|---|---|---|---|---|
| CN | 101144417 | A | 3/2008 | |
| CN | 103438000 | A | 12/2013 | |
| DE | 1551101 | A1 * | 7/1970 | F01C 1/44 |
| DE | 102011118245 | A1 | 5/2013 | |
| WO | WO 2013/068531 | A2 | 5/2013 | |

OTHER PUBLICATIONS

Written Opinion (PCT/ISA/237) dated Oct. 10, 2014, by the State Intellectual Property Office of China as the International Searching Authority for corresponding International Application No. PCT/CN2014/000700.

* cited by examiner

FIXED-RAIL ROTOR PUMP AND FIXED-RAIL ROTOR PUMP COMBINED SUPERCHARGING INTERNAL-COMBUSTION ENGINE

TECHNICAL FIELD

The present invention relates to a rotor pump, and particularly relates to a fixed-rail rotor pump and a fixed-rail rotor pump combined supercharging internal-combustion engine.

BACKGROUND

In the current engine field, reciprocating motion piston engines, rotor engines and turbine engines are mainly adopted, wherein although the properties of the reciprocating motion piston engines as the earliest samples of engines are greatly improved through constant technical transformation and improvement, the reciprocating motion piston engines are still difficult to meet the requirements of current machines on high-rotating-speed motion conditions because of being restricted by the self-structures and motion modes thereof. For solving the problem above, the rotor engines arise at the right moment, and Wankel rotor engines are representative rotor engines; compared with previous reciprocating motion piston engines, the Wankel rotor engines have the significant advantages of simple structure and high efficiency and the like; but a peculiar triangular rotor of the Wankel rotor engine has obvious defects in actual applications, and the surface, in contact with the inner wall of a cylinder, of each end angle of the triangular rotor is extremely narrow and small, so that the problems of poor sealability and large fuel consumption of co-combusted gas in a combustion chamber are difficult to solve just by arranging a single scribing device at each end angle, therefore, the efficiency of the engine is difficult to fully play, which is also one of main reasons resulting in that the rotor engines are difficult to replace reciprocating piston engines. The turbine engines have significant characteristics, but for cost performance considered, the turbine engines are mainly suitable for being used under the condition of long-term uniform-velocity running, for example, the turbine engines are used as aircraft engines. To sum up, the rotor engines have obvious advantages in the field of automobile engines, and if existing technical shortcomings can be overcome, the rotor engines have a broad development prospect.

In addition, with the strengthening of the concepts of environmental protection and energy conservation, in many countries, the standards for restricting the emission reduction of engines become increasingly higher, and treatment measures become increasingly stricter. The supercharging technology as one of approaches for improving the efficiency of engines and effectively saving energy is widely used, but the implementation of supercharging is dependent on the application of compressors, and at present, the turbocharging technology is universally adopted, although the energy saving effect is achieved by using exhaust emission, the main defect of the turbocharging mode is that the supercharging effect is not obvious under the condition of low-speed running. The other types of mechanical superchargers also have the defect of dissipating the kinetic energy of engines in different extent. Thus, a supercharging technical-plant which can adapt to stable supercharging kept under the conditions of different rotating speeds and reducing the kinetic energy consumption of engines is required so as to achieve the high-efficiency energy-saving effect of rotor engines.

SUMMARY

For overcoming the defects existing in existing engines, the present invention provides a fixed-rail rotor pump and a fixed-rail rotor pump combined supercharging internal-combustion engine consisting of multiple fixed-rail rotor pumps by combining, and the engine is compact in structure, small in volume, light in weight, stable in running, good in sealability, stable in supercharging performance, high in efficacy, and remarkable in energy-saving effect.

The present invention is implemented by adopting the following technical scheme: a fixed-rail rotor pump comprises a cylinder, cylinder end-covers and a rotor, wherein the cylinder end-covers are located on both sides of the cylinder, the rotor is arranged in the cylinder, a rotor shaft penetrates through the rotor, the cylinder end-covers are fixedly connected with the cylinder, the rotor is internally tangent to the inner wall of the cylinder, a raised fixed rail is fixed on the inner side of the cylinder end-cover on at least one side of the cylinder, the fixed rail and the cylinder are concentrically arranged, the rotor shaft penetrates through the cylinder end-covers and the fixed rail, pistons are arranged along the outer circumferential surface of the rotor, each piston is rotatably connected with the rotor by a piston rotating-shaft, the piston rotating-shafts are fixed on the rotor, the piston carries out circular swing around the piston rotating-shaft, the rotor is provided with piston grooves, the piston grooves penetrate through the axial two ends of the columniform rotor, the pistons are arranged in the piston grooves, the piston comprises a top cambered surface, a bottom cambered surface and a lateral cambered surface, the shaft center of the piston rotating-shaft is located on a circumferential line of a same radius concentric with the rotor, connecting lines among three angles of the piston constitute an equilateral triangle, the tip angle of the piston is always in contact with the inner wall of the cylinder, the bottom cambered surface of the piston is externally tangent to the outer circumferential surface of the fixed rail, and the piston carries out curvilinear motion around the fixed rail.

In the present invention, the rotor can be a columniform rotor, the side face of the columniform rotor is provided with an annular groove, and the fixed rail extends to the inside of the annular groove on the end face of the columniform rotor.

The cylinder is a cylindrical cylinder, the fixed rail is a columniform fixed rail, the rotor is fixedly sleeved on the rotor shaft, the rotor and the rotor shaft are concentrically arranged, the columniform rotor is eccentrically arranged in the cylindrical cylinder, the value of eccentricity between the columniform rotor and the cylindrical cylinder is equal to the value of radius difference between the columniform rotor and the cylindrical cylinder, the rotor shaft eccentrically penetrates through the cylinder end-covers and the columniform fixed rail, the distance between the shaft center of the piston rotating-shaft and the outer circumferential line of the annular groove is less than half of the radius difference between the annular groove and the columniform rotor, and the piston carries out circular motion around the columniform fixed rail. When the piston is a fan-shaped piston, the radiuses of the bottom cambered surface and lateral cambered surface of the piston are respectively equal to the value of radius difference between the cylindrical cylinder and the columniform fixed rail, the radians of the bottom cambered surface and the lateral cambered surface are respectively 60

DEG, the radian of the top cambered surface is equal to the radian of the inner wall of the cylindrical cylinder, the top cambered surface is internally tangent to the piston rotating-shaft, and the running range of the bottom cambered surface does not exceed the outer circumferential surface of the columniform rotor. Bounded by the internally tangent point between the columniform rotor and the inner wall of the cylindrical cylinder, when the columniform rotor runs clockwise, the left cylinder wall is at least provided with two inlets, and the right cylinder wall is provided with an outlet; and when the columniform rotor runs counterclockwise, the right cylinder wall is at least provided with two inlets, and the left cylinder wall is provided with an outlet.

The columniform fixed rail can be a sleeve, the sleeve is cylindrical, an internal tooth and an external tooth are respectively arranged on the internal surface and external surface of the sleeve and close to the cylinder end-covers, an external tooth is correspondingly arranged on the external surface of the rotor shaft, and the internal tooth on the internal surface of the sleeve is meshed with the external tooth on the external surface of the rotor shaft; and the end face of at least one side of the columniform rotor is fixedly provided with an internal toothed ring, an internal tooth of the internal toothed ring is meshed with the external tooth of the sleeve, and the outer circumferential smooth surface of the sleeve is always tangent to the bottom cambered surface of the piston.

The rotor shaft and the columniform fixed rail can be formed into an integrated structure, the columniform fixed rail eccentrically penetrates through the cylinder end-covers and the rotor, the cylinder end-cover corresponding to the end face of the columniform fixed rail is provided with a circular groove, the columniform fixed rail and the cylindrical cylinder are concentric, the rotor is a cylindrical rotor, and comprises a rotor ring and fixed rings fixed at the two ends of the rotor ring, the fixed rings extend to the insides of the circular grooves on the cylinder end-covers, the internal surface of each fixed ring is provided with an internal ring tooth, an external ring tooth is correspondingly arranged on the external surface of the columniform fixed rail, and the internal ring tooth is meshed with the external ring tooth.

A piston bearer can be arranged between the bottom cambered surface of the piston and the outer peripheral surface of the columniform fixed rail, each piston corresponds to a bearer, the bearers carry out circular motion synchronously with the pistons along the columniform fixed rail, the piston bearer comprises an upper cambered surface and a lower cambered surface, wherein the radian of the upper cambered surface is equal to the radian of the bottom cambered surface of the piston, the radian of the lower cambered surface is equal to the radian of the outer circumferential surface of the columniform fixed rail, and the lengths of the upper cambered surface and lower cambered surface of the piston bearer are not greater than the length of the bottom cambered surface of the piston.

The cylinder also can be an elliptic cylinder, at the moment, the fixed rail is an elliptic fixed rail, the columniform rotor and the elliptic cylinder are concentrically arranged, and the rotor shaft concentrically penetrates through the elliptic fixed rail and the cylinder end-covers, therefore, the columniform rotor, the rotor shaft, the elliptic fixed rail and the elliptic cylinder are concentrically arranged, the distances between the external surface of the elliptic fixed rail and the internal surface of the elliptic cylinder at any point are equivalent, and the piston carries out elliptic curvilinear motion around the elliptic fixed rail. When the piston is a fan-shaped piston, the radiuses of the bottom cambered surface and lateral cambered surface of the piston are equal to the distance between the internal surface of the elliptic cylinder and the external surface of the elliptic fixed rail, the radians of the bottom cambered surface and the lateral cambered surface are respectively 60 DEG, the radian of the top cambered surface is less than the minimum radian of the inner wall curve of the elliptic cylinder, the top cambered surface is internally tangent to the piston rotating-shaft, and the running range of the bottom cambered surface does not exceed the outer circumferential surface of the columniform rotor. Bounded by the tangent point between the columniform rotor and the inner wall of the elliptic cylinder, left and right volume cavities which are symmetrical to each other are formed, the two volume cavities are internally respectively provided with an inlet and an outlet, and the two volume cavities simultaneously carry out air intake and air exhaust.

An angle, in contact with the inner wall of the cylindrical cylinder, of the top cambered surface is a tip angle. The tip angle of the piston can be provided with a sealing device, the sealing device comprises a semi-columniform main seal strip and fan-shaped clamping plates, one surface of the semi-columniform main seal strip is in contact with the inner wall of the cylinder, the radians of the surface, in contact with the inner wall of the cylinder, of the semi-columniform main seal strip and the inner wall of the cylindrical cylinder are same, the circle center of the semi-columniform main seal strip is arranged on the contact line between the tip angle of the piston and the inner wall of the cylindrical cylinder, the surface, in contact with the inner wall of the cylinder, of the semi-columniform main seal strip is provided with at least a seal groove, a seal strip is arranged in the seal groove, the fan-shaped clamping plates are respectively arranged at the two ends of the semi-columniform main seal strip, the fan-shaped clamping plates and the semi-columniform main seal strip are concentric, one ends of the fan-shaped clamping plates are fixedly connected with the semi-columniform main seal strip, the inner sides of the other ends of the fan-shaped clamping plates are respectively provided with an arc raised strip, an arc groove is correspondingly arranged on the fan-shaped piston, and the arc raised strip is arranged in the arc groove.

For reducing the inertia force of running, the fan-shaped piston can be cavity-shaped so as to reduce the weight of the piston, and the bottom cambered surface of the piston is provided with a cavity mouth. Each cylinder end-cover is provided with a rotor cooling mouth interconnected with the fixed rail and the piston grooves, and running parts are cooled by using circulating oil.

The present invention also comprises a fixed-rail rotor pump combined supercharging internal-combustion engine, which is composed of at least two fixed-rail rotor pumps arranged on a same rotor shaft through combined connection.

The fixed-rail rotor pump combined supercharging internal-combustion engine is composed of a fixed-rail rotor pump used as a compressor and a fixed-rail rotor pump used as an internal-combustion engine through fixed connection, or composed of a fixed-rail rotor pump used as a compressor and two fixed-rail rotor pumps used as internal-combustion engines through fixed connection, or composed of a fixed-rail rotor pump used as an internal-combustion engine and two fixed-rail rotor pumps used as compressors through fixed connection.

The cylinder end-covers of adjacent two fixed-rail rotor pumps are formed into an integrated structure, so that a shared cylinder end-cover is formed. Two adjacent cylinder end-covers can be fixedly connected together.

The shared cylinder end-cover of adjacent two fixed-rail rotor pumps is provided with at least a cylindrical air jet micro-hole, the air jet micro-hole is used as an outlet of the fixed-rail rotor pump used as a compressor and used as an inlet of the fixed-rail rotor pump used as an internal-combustion engine, and the cylinder of the fixed-rail rotor pump used as an internal-combustion engine and near the air jet micro-hole is provided with a fuel nozzle and at least a spark plug.

On the premise that the radiuses of adjacent cylinders are same, the axial length of the columniform fixed-rail rotor pump used as a compressor is greater than the axial length of the columniform fixed-rail rotor pump used as an internal-combustion engine, the cylinder volume of the columniform fixed-rail rotor pump used as a compressor is greater than the cylinder volume of the columniform fixed-rail rotor pump used as an internal-combustion engine.

Bounded by a cylinder diameter line passing through the tangent point between the inner wall of the cylindrical cylinder and the columniform rotor, a deviation angle is radially arranged between the cylinders of adjacent two columniform fixed-rail rotor pumps, and the deviation angle is not greater than 60 DEG.

The columniform rotor (between adjacent fan-shaped pistons) of the fixed-rail rotor pump used as an internal-combustion engine is provided with a combustion groove.

When the columniform fixed-rail rotor pump combined supercharging internal-combustion engine comprises two columniform fixed-rail rotor pumps which are used as compressors and same in cylinder volume and one columniform fixed-rail rotor pump used as an internal-combustion engine, the columniform fixed-rail rotor pump used as an internal-combustion engine is located between the two columniform fixed-rail rotor pumps used as compressors, and the volume of the cylinder in the middle is less than the sum of the volumes of the cylinders on both sides;

When the columniform fixed-rail rotor pump combined supercharging internal-combustion engine comprises two columniform fixed-rail rotor pumps which are used as internal-combustion engines and same in cylinder volume and one columniform fixed-rail rotor pump used as a compressor, the columniform fixed-rail rotor pump used as a compressor is located between the two columniform fixed-rail rotor pumps used as internal-combustion engines, and the volume of the cylinder in the middle is greater than the sum of the volumes of the cylinders on both sides;

The present invention has the beneficial effects as follows:

(1) In the fixed-rail rotor pump designed in the present invention, because the concentric positioning of the fixed rail and the inner wall of the cylinder is implemented, the fan-shaped piston can carry out circular motion on a regular circular orbit formed between the fixed rail and the inner wall of the cylinder, so that the defect that the fan-shaped pistons of the rotor engine of the existing type are limited only by a spring or leaf spring device is overcome, then a situation that the fan-shaped piston is running smoothly under the condition of high-speed running is ensured, and no deviation phenomenon occurs, therefore, the effect of the piston can be fully played.

(2) Because the fixed-rail rotor pump has the significant effect above, the power of the supercharging engine formed by the combination of the fixed-rail rotor pumps is high.

(3) The size of the air compression pump in the fixed-rail rotor pump combined supercharging internal-combustion engine is appropriately increased, i.e. the volume of the cylinder is axially lengthened, and the volume difference between adjacent rotor pumps is changed by taking supercharging means, so that compared with various supercharging technologies for existing engines, the engine has more obvious advantages; the method solves the problems of extra energy dissipation in existing mechanical supercharging and slow response and poor effects in a low-speed turbocharging status, and the energy consumption for supercharging is small; and additional supercharging equipment is canceled, so that the internal-combustion engine is simpler, compacter and lighter in structure;

(4) The components of the sealing device are connected in a full anastomosing mode, so that the surface, in contact with the inner wall of the cylinder, of the piston is enlarged, an effect that the number of the seal strips with different functions can be increased is achieved, and the problem that the sealing effect of a single seal strip is poor is solved, therefore, the sealability is obviously improved.

As shown in the figures, 1: cylindrical cylinder; 1': elliptic cylinder; 2: cylinder end-cover; 3: columniform rotor; 3': cylindrical rotor; 301: rotor ring; 302: fixed ring; 4: rotor shaft; 5: piston groove; 6: piston; 7: piston rotating-shaft; 8: columniform fixed rail; 8': elliptic fixed rail; 801: sleeve; 9: annular groove; 10: bottom cambered surface; 11: lateral cambered surface; 12: top cambered surface; 13: inlet; 14: outlet; 15: air jet micro-hole; 16: fuel nozzle; 17: spark plug; 18: rotor cooling mouth; 19: sealing device; 20: semi-columniform main seal strip; 21: fan-shaped clamping plate; 22: arc raised strip; 23: seal groove; 24: sealing ring; 25:

rotor ring; 26: rotor ring groove; 27: internal toothed ring; 28: external toothed ring; 29: piston bearer.

SPECIFIC EMBODIMENTS

The following further describes the present invention with reference to the accompanying drawings and the embodiments.

Embodiment 1

Figure 1:
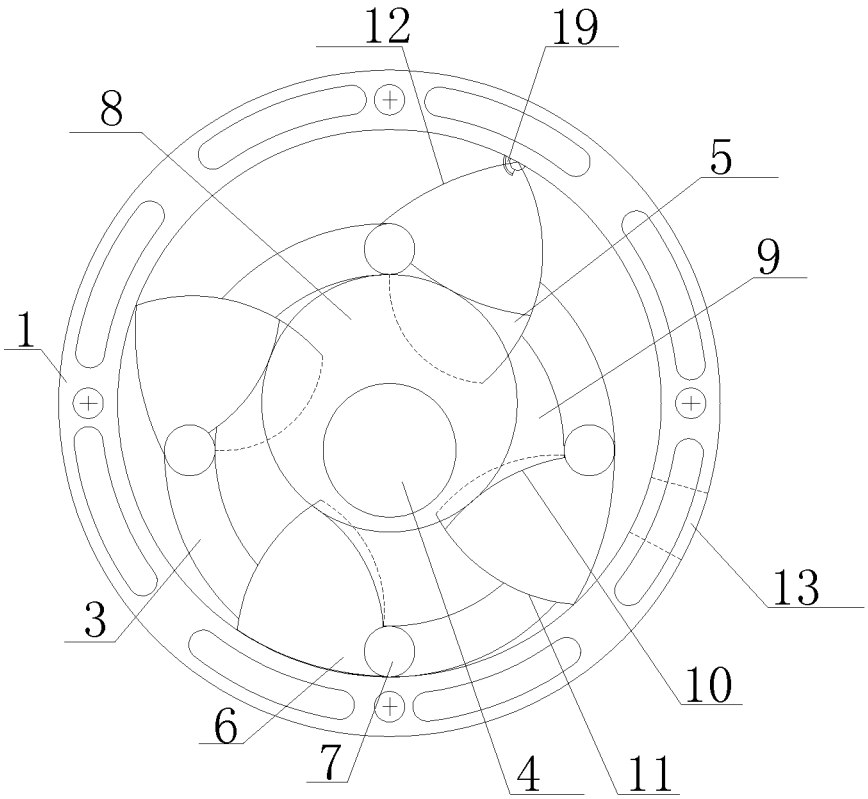
FIG. 1 is a radial sectional view of a columniform fixed-rail rotor pump according to an embodiment 1 of the present invention.
Figure 2:
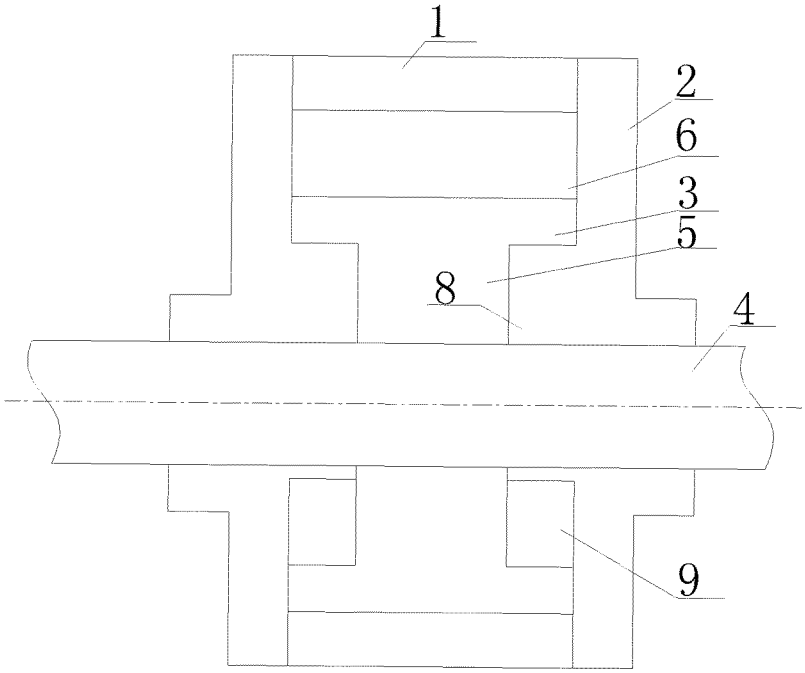
FIG. 2 is an axial sectional view of the columniform fixed-rail rotor pump shown in FIG. 1 of the present invention.

A columniform fixed-rail rotor pump is shown in FIG. 1 and FIG. 2, the columniform fixed-rail rotor pump comprises a cylindrical cylinder 1 and cylinder end-covers 2, wherein the cylinder end-covers 2 are located on both sides of the cylinder 1, the cylinder end-covers 2 and the cylinder 1 are fixedly connected, and the cylindrical cylinder 1 and the cylinder end-covers 2 can be respective separate parts, and also can be of a structure that the cylinder end-cover and the cylinder on one side are respective separate parts and the cylinder end-cover and the cylinder on the other side are formed into an integrated structure.

The columniform rotor 3 is eccentrically arranged in the cylindrical cylinder 1, and the value of eccentricity between the columniform rotor 3 and the cylindrical cylinder 1 is the value of radius difference between the columniform rotor 3 and the cylindrical cylinder 1, so that the columniform rotor 3 is always internally tangent to the inner wall of the cylindrical cylinder 1. The two end faces of the columniform rotor 3 are respectively provided with an annular groove 9, the inner side of each cylinder end-cover 2 is provided with a raised columniform fixed rail 8, and the columniform fixed rail 8 can be arranged on the cylinder end-cover on one side, and also can be simultaneously arranged on the cylinder end-covers on both sides. The columniform fixed rail 8 and the cylindrical cylinder 1 are concentrically arranged, and the columniform fixed rail 8 and the cylinder end-covers 2 can be formed into an integrated structure. The columniform rotor 3 is fixedly sleeved on the rotor shaft 4, the rotor shaft 4 eccentrically penetrates through the columniform fixed rail 8 and the cylindrical cylinder 1, and is connected with other transmission devices, and the columniform rotor 3 and the rotor shaft 4 are concentrically arranged. The diameter of the columniform fixed rail 8 is greater than the diameter of the rotor shaft 4 and less than the diameter of the columniform rotor 3, and for ensuring the strength of the columniform rotor 3, the length of the columniform fixed rail 8 is not more than two-thirds of the length of the columniform rotor 3. The columniform fixed rail 8 extends to the inside of the annular groove 9 on the end face of the columniform rotor 3, the depth of the annular groove 9 corresponds to the length of the columniform fixed rail 8, and the diameter of the annular groove is greater than the diameter of the columniform fixed rail 8 and less than the diameter of the columniform rotor 3.

At least one piston 6 is arranged along the outer circumferential surface of the columniform rotor 3, and the pistons 6 can be uniformly distributed along the outer circumferential surface of the columniform rotor, and also can be symmetrically distributed. The piston 6 is rotatably connected with the columniform rotor 3 by a piston rotating-shaft 7, the piston rotating-shaft 7 is fixed on the columniform rotor 3, and the piston 6 carries out circular swing around the piston rotating-shaft 7. Piston grooves 5 are arranged on the columniform rotor 3 according to the number of the fan-shaped piston, the piston grooves 5 penetrate through the axial two ends of the columniform rotor 3, and the pistons 6 are arranged in the piston grooves 5. The shape and size of the piston grooves 5 are matched with those of the piston 6, the piston 6 after penetrating through the piston groove 5 is in contact with the columniform fixed rail 8. The piston 6 comprises a top cambered surface 12, a bottom cambered surface 10 and a lateral cambered surface 11, the tip angle of the piston 6 is always in contact with the inner wall of the cylinder, and connecting lines among three angles of the piston 6 constitute an equilateral triangle.

The piston 6 and the piston rotating-shaft 7 can be formed into an integrated structure, at the moment, the piston 6 is a triangular piston with a piston rotating-shaft, a semicircular groove is arranged in the piston groove 5, and the piston rotating-shaft is arranged in the semicircular groove and rotates in the semicircular groove. The piston 6 and the piston rotating-shaft 7 also can be two separate parts, at the moment, the piston rotating-shaft 7 and the columniform rotor 3 are formed into an integrated structure, and at the moment, the piston is a fan-shaped piston. The radians of the bottom cambered surface 10 and lateral cambered surface 11 of the fan-shaped piston are respectively 60 DEG, and the radiuses of the bottom cambered surface and the lateral cambered surface are the value of radius difference between the cylindrical cylinder 1 and the columniform fixed rail 8. A cambered surface from the end angle point as the circle center of the piston rotating-shaft to the tip angle in contact with the inner wall of the cylinder is the top cambered surface 12, the radian of the top cambered surface 12 is equal to the radian of the cylindrical cylinder 1, the function of the top cambered surface 12 is to farthest reduce the volume clearance of the cylinder, and the top cambered surface 12 is internally tangent to the piston rotating-shaft 7. The shaft centers of the piston rotating-shafts 7 are all located at the circumferential line of the same radius concentric with the columniform rotor $\mathbf{3}|_{[S1]}$, and the distance between the shaft center of the piston rotating-shaft 7 and the outer circumferential line of the annular groove 9 is less than half of the radius difference between the annular groove and the columniform rotor so as to ensure that the bottom cambered surface 10 of the fan-shaped piston 6 is always externally tangent to the outer circumferential surface of the columniform fixed rail 8 in the process of running. The maximum running range of the bottom cambered surface 10 does not exceed the outer circumference of the columniform rotor 3. Each fan-shaped piston carries out circular motion around the columniform fixed rail 8.

Bounded by the tangent point between the columniform rotor 3 and the inner wall of the cylindrical cylinder 1, when the columniform rotor 3 runs clockwise, the left cylinder wall is at least provided with two inlets 13, and the right cylinder wall is provided with an outlet 14; and when the columniform rotor 3 runs counterclockwise, the right cylinder wall is at least provided with two inlets 13, and the left cylinder wall is provided with an outlet 14. The purpose of the arrangement of the multiple inlets is to reduce the negative pressure generated by a volume cavity between adjacent pistons in the process of absorption. The number of the outlet 14 is determined according to the number of the fan-shaped piston. When the columniform fixed-rail rotor pump is separately used as compression equipment, whether the columniform rotor 3 runs clockwise or counterclockwise, in the rotating direction of the columniform rotor, the piston is preferably arranged behind the piston rotating-shaft 7.

The radial two end faces of the fan-shaped piston are provided with seal grooves and seal strips, and a circular seal groove and a sealing ring 24 for strengthening the sealability are respectively arranged at the positions corresponding to the columniform rotor and on the inner walls of the two cylinder end-covers. On this basis, on the premise of not affecting the overall performance of the cylinder, the two ends of the columniform rotor also can be respectively additionally provided with a rotor ring 25 of which the radius is equal to that of the columniform rotor and with certain thickness. A rotor ring groove 26 corresponding to the rotor ring 25 is arranged on the inner wall of the cylinder end-cover. For reducing the inertia force of running, the fan-shaped piston can be cavity-shaped, and the bottom cambered surface is provided with a cavity mouth. Each cylinder end-cover is provided with a rotor cooling mouth interconnected with the piston grooves, and running parts are cooled by using circulating oil.

Figure 5:
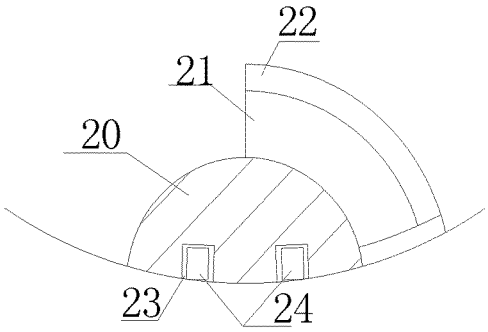
FIG. 5 is a transverse sectional view of a sealing device according to the present invention.
Figure 6:
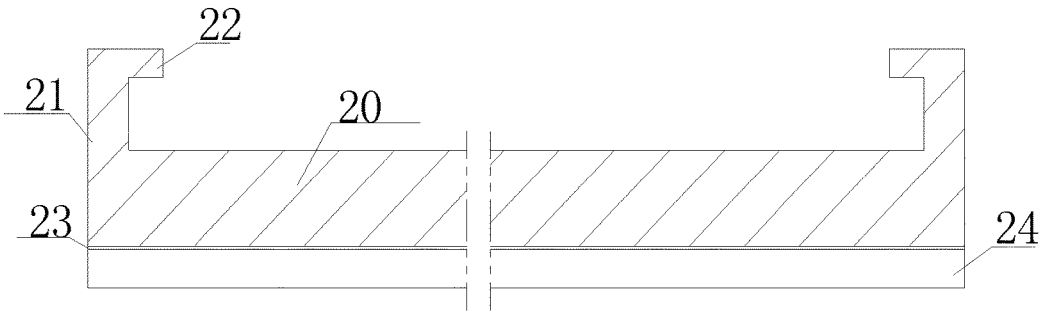
FIG. 6 is an axial sectional view of the sealing device according to the present invention.

If the columniform fixed-rail rotor pump is only used as a common pump and a compressor under general conditions, only by adopting a conventional sealing means of arranging a narrow seal groove at the top angle end of the fan-shaped piston and arranging a seal strip in the seal groove, the sealing of the fan-shaped piston can be realized. Or no additional sealing measure is taken to the top angle end of the fan-shaped piston, so that the structure of the fan-shaped piston is relatively simple, therefore, the production cost can be reduced. But the columniform fixed-rail rotor has high sealing and lubrication requirements on internal parts of the cylinder under the working conditions of high-temperature, high-pressure and high-speed running, at the moment, the sealing device shown in FIG. 5 is adopted, the sealing device 19 is arranged at the tip angle of the piston, i.e. at the angle where the top cabmbered surface of the piston slides along the inner wall of the cylinder. The sealing device comprises a semi-columniform main seal strip 20 and fan-shaped clamping plates 21, and one surface of the semi-columniform main seal strip 20 is in contact with the inner wall of the cylinder, therefore, the radians of the surface, in contact with the inner wall of the cylinder, of the semi-columniform main seal strip 20 and the inner wall of the cylindrical cylinder are exactly matched. The circle center of the semi-columniform main seal strip 20 is arranged on the contact line between the tip angle of the piston and the inner wall of the cylindrical cylinder, and the tip angle of the piston is an angle, in contact with the inner wall of the cylindrical cylinder, of the top cambered surface of the piston. By arranging the semi-columniform main seal strip 20, the surface, in contact with the inner wall of the cylinder, of the sealing device 19 is enlarged, the surface, in contact with the inner wall of the cylinder, of the semi-columniform main seal strip 20 is provided with multiple seal grooves 23, and a seal strip is respectively arranged in the seal grooves, so that the sealing effect is improved. The fan-shaped clamping plates 21 are respectively arranged at the two ends of the semi-columniform main seal strip 20, the fan-shaped clamping plates 21 and the semi-columniform main seal strip are concentric, one ends of the fan-shaped clamping plates 21 are fixedly connected with the semi-columniform main seal strip 20, the inner sides of the other ends of the fan-shaped clamping plates are respectively provided with an arc raised strip 22, an arc groove is correspondingly arranged on the fan-shaped piston, and the arc raised strips 22 are arranged in the arc grooves, when the piston is arranged at any angle position, the sealing device 19 is not disengaged, and the sealing device and the piston are always kept in a smooth running state, thereby preventing the sealing device 19 from being disengaged in the process of piston running. After the sealing device is arranged, the acting force borne on the top cambered surface 12 of the piston 6 is a centripetal force, so that the friction force between the top angle end of the piston 6 and the inner wall of the cylinder is small.

A single columniform fixed-rail rotor pump can be used as a rotor pump or a compressor. When the rotor pump is running, the fan-shaped piston is driven to rotate when the columniform rotor 3 rotates, and because the bottom cambered surface of the fan-shaped piston is always tangent to the columniform fixed rail 8, the fan-shaped piston always rotates around the columniform fixed rail 8. In the rotating process of the fan-shaped piston, a material is fed between the fan-shaped pistons from the inlet 13, and in the rotating process of the fan-shaped piston, the material between the pistons are compressed, and then the compressed material is discharged through the outlet 14.

Embodiment 2

Figure 3:
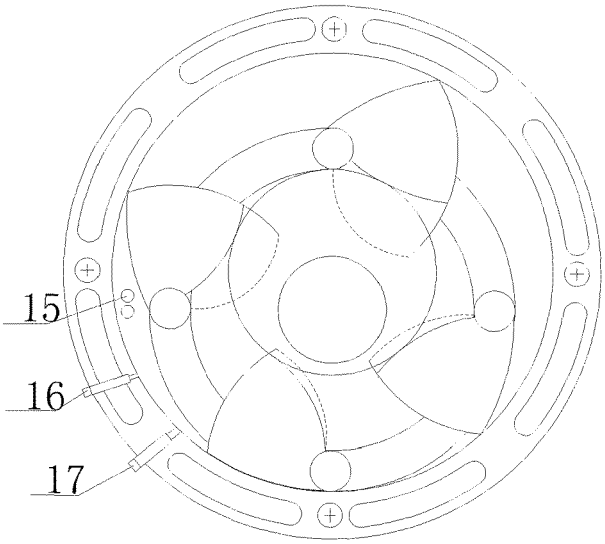
FIG. 3 is a radial sectional view of a columniform fixed-rail rotor pump combined supercharging internal-combustion engine according to the present invention.
Figure 4:
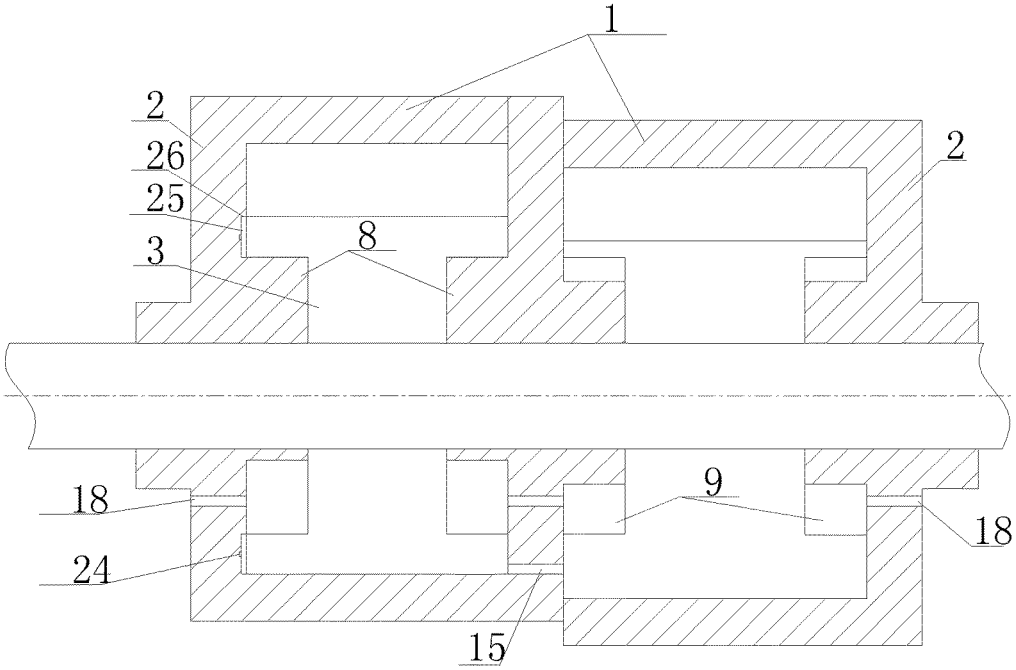
FIG. 4 is an axial sectional view of the fixed-rail rotor pump combined supercharging internal-combustion engine shown in FIG. 3.

A fixed-rail rotor pump combined supercharging internal-combustion engine is shown in FIG. 3 and FIG. 4, the engine is composed of two columniform fixed-rail rotor pumps which are sleeved on a same rotor shaft and connected in series. After the two columniform fixed-rail rotor pumps are connected in series on a same rotor shaft, adjacent cylinder end-covers 2 are mutually overlapped, and for ensuring the compactness and firmness of the structure, two adjacent cylinder end-covers 2 can be formed into an integrated structure. One of the columniform fixed-rail rotor pumps achieves the effect of an air compressor, and the other one of the columniform fixed-rail rotor pumps achieves the effect of an internal-combustion engine. At the moment, the outlet of the columniform fixed-rail rotor pump used as a compressor is arranged on the shared cylinder end-cover 2 of the two rotor pumps, the outlet is a cylindrical air jet micro-hole 15, the diameter of the air jet micro-hole is associated with the factors such as the volume of the cylinder and the number of the piston, and the like, and the diameter of the air jet micro-hole is generally 0.1-10 mm. Similarly, the inlet of the columniform fixed-rail rotor pump used as an internal-combustion engine is an air jet micro-hole 15, and the purpose of the adoption of the air jet micro-hole is to force co-combusted gas disturbance by using the jet action of airflow, so that the combustion efficiency is increased. A fuel nozzle 1 and at least one spark plug 17 are installed on the cylinder 1 of the columniform fixed-rail rotor pump used as an internal-combustion engine and near the air jet micro-hole. If the fuel is diesel, direct compression ignition is implemented without using a spark plug. The fuel nozzle is arranged at a position near the inlet of the rotor pump, and dead against the inlet, so that the atomization effect of the fuel can be improved. The spark plug is arranged near the internally tangent position between the columniform rotor and the inner wall of the cylinder. The columniform rotor of the fixed-rail rotor pump used as an internal-combustion engine and arranged between adjacent fan-shaped pistons is provided with a combustion groove, and due to the combustion groove, compressed gas can get rid of the limit of a closed area of the tangent point between the columniform rotor and the inner wall of the cylinder, and then is smoothly transmitted to an expansion acting area.

In the embodiment, the axial length of the columniform fixed-rail rotor pump used as a compressor can be appropriately increased, which aims to increase the internal volume of the cylinder, so that when the axial length of the columniform fixed-rail rotor pump used as a compressor is greater than the axial length of the columniform fixed-rail rotor pump used as an internal-combustion engine, an increasing effect can be achieved, and the larger the volume difference between the cylinders of the two is, the larger the supercharged value is, therefore, the stable supercharging performance can be kept under any rotating speed conditions.

By taking the cylinder diameter line (passing through the tangent point between the inner wall of the cylindrical cylinder 1 and the columniform rotor) of the cylinder as the standard, a certain deviation angle is required to be radially arranged between adjacent two cylinders, and the deviation angle is not more than 60 DEG so as to ensure that the fixed-rail rotor pump combined supercharging internal-combustion engine can fully play the functions itself. A same rotor shaft penetrates through adjacent two cylinders, so that no radial deviation exists between the columniform rotors of the two adjacent cylinders, therefore, the radial pistons of the fan-shaped pistons on adjacent two columniform rotors are still overlapped and synchronously running. By setting the deviation angle, compressed gas in the internal-combustion engine can be prevented from inversely flowing into the compressor, and when the engine is running, the piston of the rotor pump used as a compressor and a piston in a corresponding combustion acting rotor pump are always kept at anteroposterior positions, thereby facilitating that the internal-combustion engine completes the process of air intake, further compression, combustion and expansion acting. A sealing device is required to be arranged at the tip angle of the piston.

When the internal-combustion engine is running, the fixed-rail rotor pump used as a compressor carries out compression on air firstly, and then the compressed air enters the columniform fixed-rail rotor pump used as an internal-combustion engine through the air jet micro-hole 15, wherein under the rotating action of the columniform rotor, the piston in the columniform fixed-rail rotor pump sequentially completes the processes of air intake, compression, combustion and expansion acting.

The others are the same as those in the embodiment 1.

Embodiment 3

The combination mode of the fixed-rail rotor pump combined supercharging internal-combustion engines is not limited to the combination mode in the embodiment 2, and also can include the following combination modes:

(1) the columniform fixed-rail rotor pump combined supercharging internal-combustion engine comprises two columniform fixed-rail rotor pumps which are used as compressors and same in cylinder volume and one columniform fixed-rail rotor pump used as an internal-combustion engine, wherein the columniform fixed-rail rotor pump used as an internal-combustion engine is located between the two columniform fixed-rail rotor pumps used as compressors, and the volume of the cylinder in the middle is less than the sum of the volumes of the cylinders on both sides;

(2) the columniform fixed-rail rotor pump combined supercharging internal-combustion engine comprises two columniform fixed-rail rotor pumps which are used as internal-combustion engines and same in cylinder volume and one columniform fixed-rail rotor pump used as a compressor, wherein the columniform fixed-rail rotor pump used as a compressor is located between the two columniform fixed-rail rotor pumps used as internal-combustion engines, and the volume of the cylinder in the middle is greater than the sum of the volumes of the cylinders on both sides;

In both cases above, a deflection angle exists between adjacent columniform fixed-rail rotor pumps, and the deflection angle is not more than 90 DEG. But three columniform fixed-rail rotor pumps are penetrated by a same rotor shaft.

The internal-combustion engine in the two combination modes above adopts a shared cylinder end-cover, the shared cylinder end-cover not only relates to a problem of the deflection angle existing between adjacent cylinders, but also relates to the difficulty of cylinder part processing, and the robustness and convenience problems of installation. Thus, according to actual production situations, the shared cylinder end-cover can adopt the following three structure modes: (1) the two side end-covers of a middle cylinder and adjacent cylinder end-covers thereof are arranged in a separated mode; (2) one side end-cover of the middle cylinder and an adjacent cylinder end-cover thereof are mutually shared, and the other side end-cover and an adjacent cylinder end-cover thereof are arranged in a separated mode; and (3) the two side end-covers of the middle cylinder and adjacent cylinder end-covers thereof are mutually shared. No matter which installation mode is adopted, the installation and removal of the rotor shaft are not affected.

In addition, the recombination mode of the columniform fixed-rail rotor pump combined supercharging internal-combustion engines also can be adopted, i.e. multiple columniform fixed-rail rotor pump combined supercharging internal-combustion engines are arranged on a same rotor shaft.

The others are the same as those in the embodiment.

Embodiment 4

Figure 7:
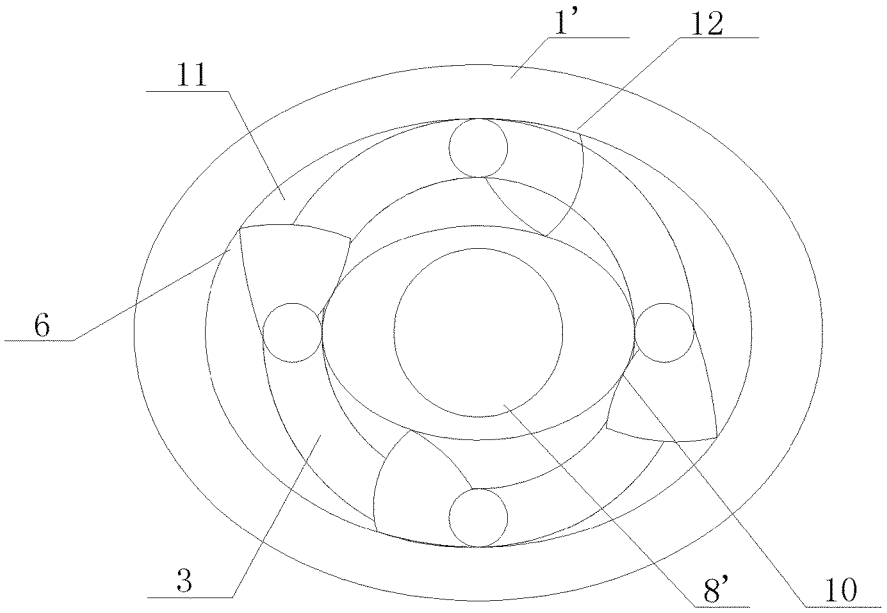
FIG. 7 is a radial sectional view of an elliptic fixed-rail rotor pump according to the embodiment 4 of the present invention.

The elliptical fixed-rail rotor pump is shown in FIG. 7, unlike the embodiment 1, the cylinder in the embodiment is an elliptic cylinder 1', the cylinder end-covers 2 are located on both sides of the cylinder 1', and the cylinder end-covers 2 are fixedly connected with the cylinder 1'.

The columniform rotor 3 is arranged in the elliptic cylinder 1', the columniform rotor 3 and the elliptic cylinder 1' are concentrically arranged, and the columniform rotor 3 is always internally tangent to the short-axis vertex of an arc of the inner wall of the elliptic cylinder 1', so that two volume cavities which are symmetrical to each other and oppositely closed are formed. Two side faces of the columniform rotor 3 are respectively provided with an annular groove 9, the inner side of each cylinder end-cover 2 is provided with a raised elliptic fixed rail 8', the elliptic fixed rail 8' and the cylinder end-cover 2 are concentrically arranged, the columniform rotor 3 is fixedly sleeved on the rotor shaft 4, and the columniform rotor 3 and the rotor shaft 4 are concentrically arranged, therefore, the columniform rotor 3, the rotor shaft 4, the elliptic fixed rail 8' and the elliptic cylinder 1' are concentrically arranged, and the distances between the external surface of the elliptic fixed rail 8' and the internal surface of the elliptic cylinder 1' are always equal at any point. The rotor shaft 4 concentrically penetrates through the elliptic fixed rail 8' and the cylinder end-covers 2, and is connected with the other transmission devices. The elliptic fixed rail 8' extends to the inside of the annular groove 9 on the end face of the columniform rotor 3, the depth of the annular groove 9 corresponds to the length of the elliptic fixed rail 8', and the diameter of the annular groove is greater than the short-axis length of the elliptic fixed rail 8', and less than the diameter of the columniform rotor 3.

In the embodiment, the arrangement of the pistons 6 and the piston grooves 5 is completely same as the arrangement of the pistons 6 and the piston grooves 5 in the embodiment 1. When the piston 6 is a fan-shaped piston, the radians of the bottom cambered surface 10 and lateral cambered surface 11 of the fan-shaped piston are respectively 60 DEG, and the radiuses of the bottom cambered surface and the lateral cambered surface are equal to the distance between the internal surface of the cylindrical cylinder 1 and the external surface of the columniform fixed rail 8. A cambered surface from the end angle point as the circle center of the piston rotating-shaft to the tip angle in contact with the inner wall of the cylinder is the top cambered surface 12, the radian of the top cambered surface 12 is less than the minimum radian of the inner wall curve of the elliptic cylinder 1', and the bottom cambered surface 10 is always in contact with the outer circumference of the elliptic fixed rail 8'. The shaft centers of the piston rotating-shafts 7 are all located on a circumferential line of the same radius concentric with the elliptic fixed rail 8'$|_{[S2]}$. The columniform rotor 3 in the process of carrying out circular motion drives the fan-shaped piston to move in an elliptic annular space between the elliptic fixed rail 8' and the elliptic cylinder 1'. The maximum running range of the bottom cambered surface 10 does not exceed the outer circumference of the columniform rotor 3.

Bounded by the tangent point between the columniform rotor 3 and the elliptic cylinder 1', left and right volume cavities which are symmetrical to each other are formed, and the two volume cavities are respectively internally provided with an inlet and an outlet, so that the two volume cavities achieve the effect of simultaneous air intake and air exhaust.

The elliptic fixed-rail rotor pump is internally provided with a single inlet and outlet, and after an ignition device and a fuel injection device are arranged in the rotor pump, the obtained device can be directly transformed into an internal-combustion engine, so that the columniform rotor can achieve the process of air intake, compression, combustion and exhaust after making a full revolution, and an air inlet and an air outlet are not required to be additionally arranged, therefore, the structure is simple.

The shapes of the fixed rail and the cylinder are not limited to an ellipse described in the embodiment, and also can be an approximate ellipse consisting of symmetrical arcs which are connected by using a smooth curve and different in radius, as long as a situation that the shapes of the fixed rail and the cylinder are same and the distances between the two are equal at any point can be guaranteed.

The combination mode and acting principle of the elliptic fixed-rail rotor pump combined supercharging internal-combustion engines are same as those of the columniform fixed-rail rotor pump combined supercharging internal-combustion engine in the embodiment 2 and the embodiment 3, so the repetitious details need not be given here.

The others are the same as those in the embodiment 1.

Embodiment 5

Figure 8:
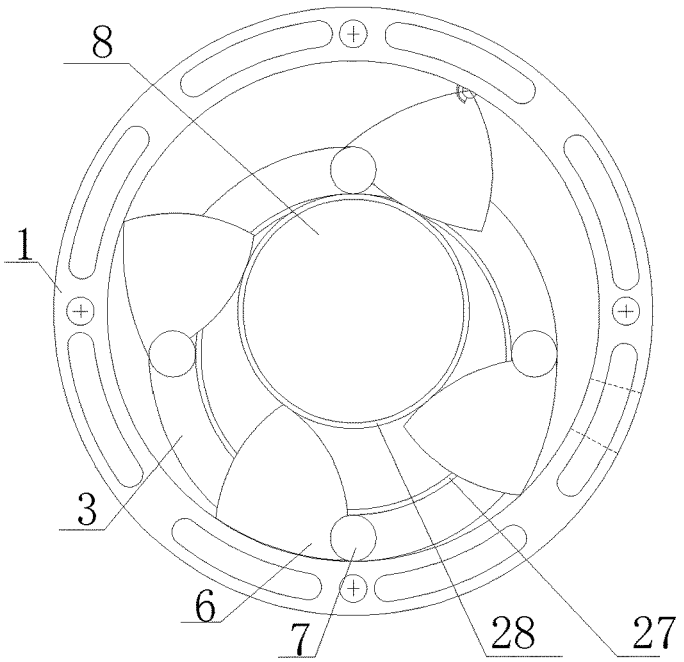
FIG. 8 is a radial sectional view of a columniform fixed-rail rotor pump according to the embodiment 5 of the present invention.
Figure 9:
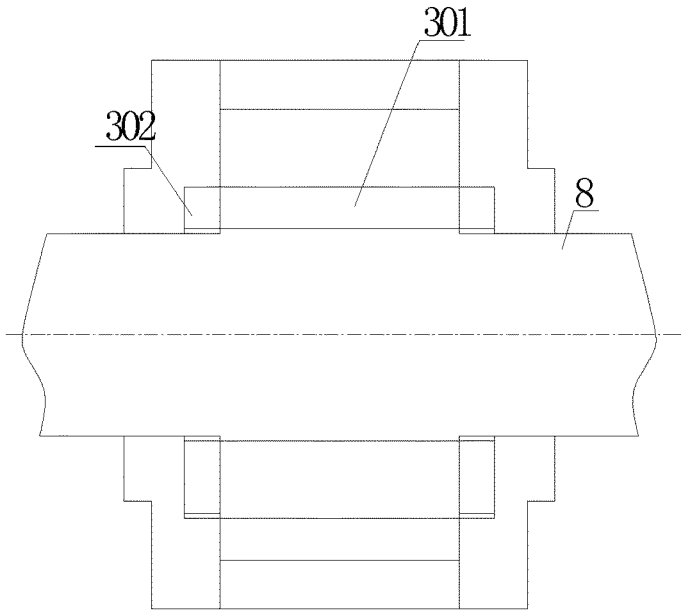
FIG. 9 is an axial sectional view of a columniform fixed-rail rotor pump shown in FIG. 8.

The columniform fixed-rail rotor pump in the embodiment 5 is shown in FIG. 8 and FIG. 9, unlike the embodiment 1, in this embodiment, the rotor shaft and the columniform fixed rail are formed into an integrated structure, and the cylinder end-cover 2 corresponding to the end face of the columniform fixed rail 8 is provided with a circular groove. The columniform fixed rail 8 and the cylindrical cylinder 1 are concentric. The rotor 3' is cylindrical, the cylindrical rotor 3' eccentrically penetrates through the cylindrical cylinder, the cylindrical rotor 3' comprises a rotor ring 301 and fixed rings 302 fixed at the two ends of the rotor ring 301, and the fixed rings 302 extend to the insides of the circular grooves on the cylinder end-covers so as to achieve the effects of strengthening the sealability and controlling the rotation of the rotor ring. The internal surface of each fixed ring 302 is provided with an internal ring tooth 27, the external surface of the columniform fixed rail 8 is correspondingly provided with an external ring tooth 28, and the internal ring tooth 27 is meshed with the external ring tooth 28. The rotor ring 301 is meshed with the external ring tooth through the internal ring tooth so as to drive the columniform fixed rail 8 to rotate, and once the rotor ring 301 makes a full revolution, the columniform fixed rail 8 rotates in a range of more than a full revolution.

The cylindrical rotor 3' is eccentrically arranged in the cylindrical cylinder 1, and internally tangent to the inner wall of the cylinder. The cylindrical rotor 3' is provided with piston grooves, and the fan-shaped pistons are arranged in the piston grooves. The tip angle of the fan-shaped piston is always in contact with the inner wall of the cylinder, the bottom cambered surface of the fan-shaped piston is always in contact with the columniform fixed rail 8, and each fan-shaped piston carries out circular motion around the columniform fixed rail 8.

The combination modes and acting principle of the columniform fixed-rail rotor pump combined supercharging internal-combustion engine are same as those of the columniform fixed-rail rotor pump combined supercharging internal-combustion engine in the embodiment 2 and the embodiment 3, so the repetitious details need not be given here.

The others are the same as those in the embodiment 1.

Embodiment 6

Figure 10:
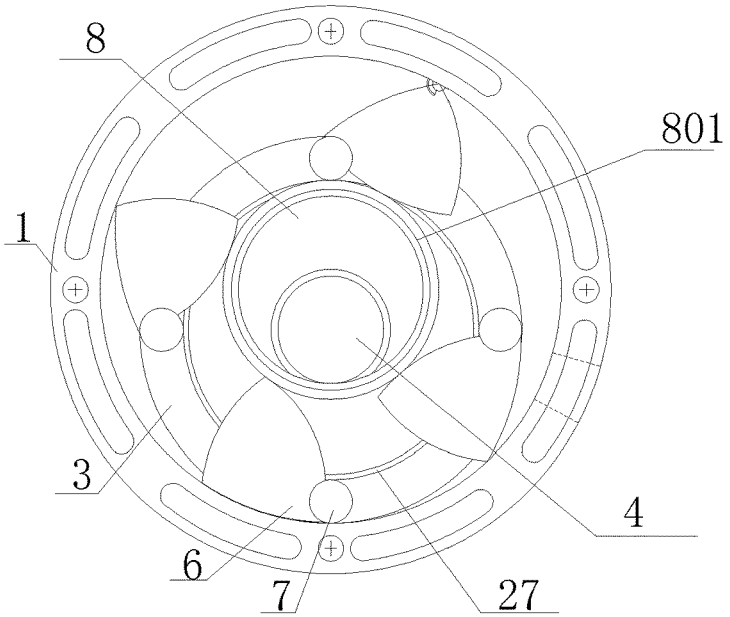
FIG. 10 is a radial sectional view of a columniform fixed-rail rotor pump according to the embodiment 6 of the present invention.
Figure 11:
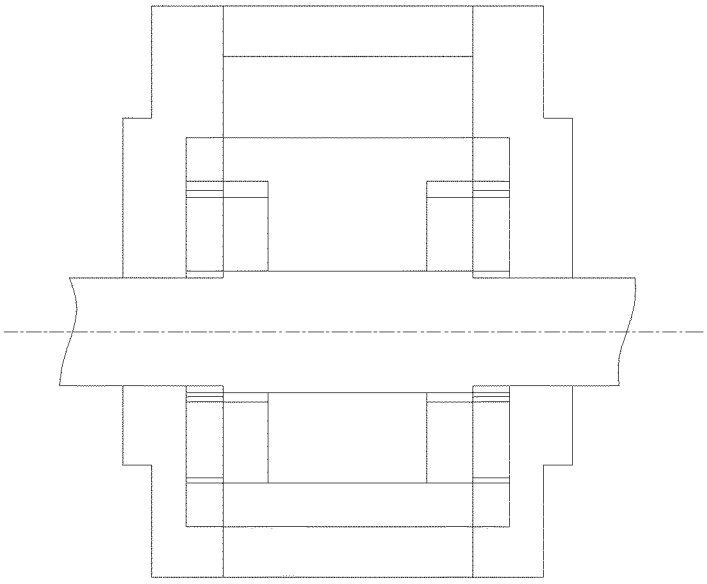
FIG. 11 is an axial sectional view of a columniform fixed-rail rotor pump shown in FIG. 10.

The columniform fixed-rail rotor pump in the embodiment 6 is shown in FIG. 10 and FIG. 11, unlike the embodiment 1, the columniform fixed rail is of a sleeve-type structure, i.e. the columniform fixed rail is a sleeve 801, the sleeve 801 is cylindrical, an internal tooth and an external tooth are respectively arranged on the internal surface and external surface of the sleeve and close to the cylinder end-covers, an external tooth is correspondingly arranged on the external surface of the rotor shaft 4, and the internal tooth on the internal surface of the sleeve 801 is meshed with the external tooth on the external surface of the rotor shaft 4. An internal toothed ring is fixedly arranged on the end face of one side of the columniform rotor 3 and the end faces of both sides of the columniform rotor 3, and the internal tooth of the internal toothed ring is meshed with the external tooth of the sleeve 801. The outer circumferential smooth surface of the sleeve 801 is still always in contact with the bottom cambered surface of the fan-shaped piston.

The columniform rotor 3 drives the columniform fixed rail 8 to rotate through the internal toothed ring, and the columniform fixed rail 8 drives the rotor shaft 4 to rotate through the meshing of the internal tooth of the columniform fixed rail 8 and the external tooth of the rotor shaft 4, so that the doubled and redoubled increasing of the rotating speed of the rotor shaft 4 is realized finally.

The combination mode and acting principle of the columniform fixed-rail rotor pump combined supercharging internal-combustion engine described in the embodiment are same as those of the columniform fixed-rail rotor pump combined supercharging internal-combustion engine in the embodiment 2 and the embodiment 3, so the repetitious details need not be given here.

The others are the same as those in the embodiment 1.

Embodiment 7

Figure 12:
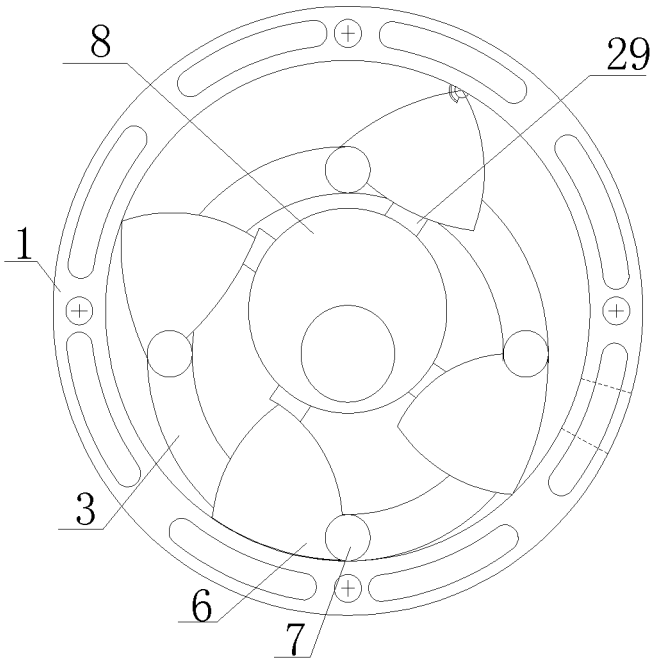
FIG. 12 is a radial sectional view of a columniform fixed-rail rotor pump according to the embodiment 7 of the present invention.
Figure 13:
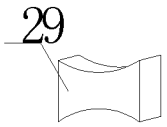
FIG. 13 is a solid diagram of a piston bearer.

The columniform fixed-rail rotor pump in the embodiment 7 is shown in FIG. 12 and FIG. 13, unlike the embodiment 1, a piston bearer 29 is arranged between the bottom cambered surface of the piston and the outer circumferential surface of the columniform fixed rail 8, and one piston corresponds to a piston bearer. The piston bearers carry out circular motion synchronously with the piston along the columniform fixed rail.

The piston bearer 29 comprises an upper cambered surface and a lower cambered surface, wherein the upper cambered surface is identical to the bottom cambered surface of the piston, and the radians of the two are equal; and the lower cambered surface is identical to the outer circumferential surface of the columniform fixed rail, and the radians of the two are equal. The minimum distance between the upper cambered surface and the lower cambered surface should be equal to the difference between the original radius of the columniform fixed rail before the piston bearer is arranged and the radius of the columniform fixed rail after the piston bearer is arranged. The lengths of the upper and lower cambered surfaces of the piston bearer 29 should be not greater than the length of the bottom cambered surface of the fan-shaped piston.

Although the bottom cambered surface of the fan-shaped piston in the embodiment 1 can be always in contact with the outer circumferential surface of the columniform fixed rail, defects in the following two aspects still exist: 1, the surface, in contact with the columniform fixed rail, of the piston is narrow and small, so that a situation that the sealability is reduced due to rapid wear occurs under long-term high-load running conditions; and 2, the designed position of the shaft center point of the fan-shaped piston has certain limitations, when the shaft center point of the fan-shaped piston is excessively deflected to the outer circumferential surface of the rotor, a situation that the bottom cambered surface of the piston is separated from the columniform fixed rail at the local corner position is caused, and a situation that the sealability is lost is also caused. Through arranging the piston bearer 29 in the embodiment, the problems above can be completely solved.

The combination mode and acting principle of the columniform fixed-rail rotor pump combined supercharging internal-combustion engine in the embodiment are same as those of the columniform fixed-rail rotor pump combined supercharging internal-combustion engine in the embodiment 2 and the embodiment 3, so the repetitious details need not be given here.

The others are the same as those in the embodiment 1.

What is claimed is:

1. A fixed-rail rotor pump, comprising:

a cylinder, cylinder end-covers and a rotor; wherein the cylinder end-covers are located on both sides of the cylinder, the rotor is arranged in the cylinder, a rotor shaft penetrates through the rotor, the cylinder end-covers are fixedly connected with the cylinder; wherein the rotor is internally tangent to an inner wall of the cylinder, a fixed rail is fixed on an inner side of the cylinder end-covers on at least one side of the cylinder, the fixed rail and the cylinder are concentrically arranged, the rotor shaft penetrates through the cylinder end-covers and the fixed rail;

a plurality of pistons are arranged along an outer circumferential surface of the rotor, wherein each piston is rotatably connected with the rotor by a piston rotating-shaft, the piston rotating-shaft is fixed on the rotor, each of the plurality of pistons carries out a circular swing around the piston rotating-shaft;

the rotor is provided with a plurality of piston grooves, wherein the plurality of piston grooves axially penetrate through two ends of the rotor;

the plurality of pistons are arranged in the plurality of piston grooves;

each piston comprises a top cambered surface, a bottom cambered surface and a lateral cambered surface; wherein connecting lines among three angles of each piston constitute an equilateral triangle, a shaft center of the piston rotating-shaft is located on a circumferential line of a same radius concentric with the rotor, a tip angle of each piston is always in contact with the inner wall of the cylinder, the bottom cambered surface of each piston is externally tangent to an outer circumferential surface of the fixed rail, and each piston carries out a curvilinear motion around the fixed rail.

2. The fixed-rail rotor pump according to claim 1, wherein the rotor is a columniform rotor, an end face of the columniform rotor is provided with an annular groove, and the fixed rail extends to the inside of the annular groove on the end face of the columniform rotor.

3. The fixed-rail rotor pump according to claim 2, wherein the rotor is fixedly sleeved on the rotor shaft, the rotor and the rotor shaft are concentrically arranged, the cylinder is a cylindrical cylinder, the fixed rail is a columniform fixed rail, the columniform rotor is eccentrically arranged in the cylindrical cylinder;

a value of eccentricity between the columniform rotor and the cylindrical cylinder is equal to a value of a radius difference between the columniform rotor and the cylindrical cylinder;

the rotor shaft eccentrically penetrates through the cylinder end-covers and the columniform fixed rail;

the distance between the shaft center of the piston rotating-shaft and an outer circumferential line of the annular groove is less than half of a radius difference between the annular groove and the columniform rotor; and the piston carries out circular motion around the columniform fixed rail.

4. The fixed-rail rotor pump according to claim 3, wherein the columniform fixed rail is a sleeve, the sleeve is cylindrical, a first internal tooth and a first external tooth are respectively arranged on an internal surface and an external surface of the sleeve and close to the cylinder end-covers;

a second external tooth is correspondingly arranged on a external surface of the rotor shaft, and the first internal tooth on the internal surface of the sleeve is meshed with the second external tooth on the external surface of the rotor shaft;

the end face of at least one side of the columniform rotor is fixedly provided with an internal toothed ring;

a second internal tooth of the internal toothed ring is meshed with the first external tooth of the sleeve, and an outer circumferential smooth surface of the sleeve is always tangent to the bottom cambered surface of each piston.

5. The fixed-rail rotor pump according to claim 2, wherein the cylinder is an elliptic cylinder, the fixed rail is an elliptic fixed rail, the columniform rotor and the elliptic cylinder are concentrically arranged, and the rotor shaft concentrically penetrates through the elliptic fixed rail and the cylinder end-covers, therefore, the columniform rotor, the rotor shaft, the elliptic-fixed rail and the elliptic cylinder are concentrically arranged;

the distances between an external surface of the elliptic fixed rail and an internal surface of the elliptic cylinder are equivalent at any point; and each piston carries out elliptic curvilinear motion around the elliptic fixed rail.

6. The fixed-rail rotor pump according to claim 5, wherein when the piston has a fan shape, radiuses of the bottom cambered surface and lateral cambered surface of the piston are equal to a value of a distance between the internal surface of the elliptic cylinder and the external surface of the elliptic fixed rail;

the radians of the bottom cambered surface and the lateral cambered surface of the piston are respectively 60 DEG;

the radian of the top cambered surface of the piston is less than a minimum radian of a inner wall curve of the elliptic cylinder;

the top cambered surface of the piston is internally tangent to the piston rotating-shaft; and a running range of the bottom cambered surface of the piston does not exceed the outer circumferential surface of the rotor.

7. The fixed-rail rotor pump according to claim 2, wherein a piston bearer is arranged between the bottom cambered surface of each piston and the outer circumferential surface of the columniform fixed rail;

each piston corresponds to one piston bearer, the piston bearer carries out circular motion synchronized with the piston along the columniform fixed rail;

the piston bearer comprises an upper cambered surface and a lower cambered surface;

a radian of the upper cambered surface of the piston bearer is equal to a radian of the bottom cambered surface of the piston;

a radian of the lower cambered surface of the piston bearer is equal to a radian of the outer circumferential surface of the columniform fixed rail; and lengths of the upper cambered surface and lower cambered surface of the piston bearer are not greater than a length of the bottom cambered surface of the piston.

8. The fixed-rail rotor pump according to claim 2, wherein when the piston has a fan shape, radiuses of the bottom cambered surface and lateral cambered surface of the piston are equal to a value of radius distance between the cylindrical cylinder and the columniform fixed rail;

radians of the bottom cambered surface and the lateral cambered surface of the piston are respectively 60 DEG;

the radian of the top cambered surface of the piston is equal to the radian of the inner wall of the cylinder;

the top cambered surface of the piston is internally tangent to the piston rotating-shaft; and a running range of the bottom cambered surface of the piston does not exceed the outer circumferential surface of the columniform rotor.

9. The fixed-rail rotor pump according to claim 8, wherein the tip angle of each piston is provided with a sealing device, the sealing device comprises a semi-columniform main seal strip and a fan-shaped clamping plate; wherein one surface of the semi-columniform main seal strip is in contact with the inner wall of the cylinder;

a radian of a surface, in contact with the inner wall of the cylinder, of the semi-columniform main seal strip and the inner wall of the cylinder are same;

a circle center of the semi-columniform main seal strip is arranged on a contact line between the tip angle of the piston and the inner wall of the cylinder;

the surface, in contact with the inner wall of the cylinder, of the semi-columniform main seal strip is provided with at least a seal groove;

a seal strip is arranged in the seal groove, the plurality of fan-shaped clamping plates are respectively arranged at two ends of the semi-columniform main seal strip;

the plurality of fan-shaped clamping plates and the semi-columniform main seal strip are concentric;

a first end of each of the plurality of fan-shaped clamping plates is fixedly connected with the semi-columniform main seal strip;

an inner side of a second end of each of the plurality of fan-shaped clamping plates is respectively provided with an arc raised strip;

an arc groove is correspondingly arranged on a fan-shaped piston; and the arc raised strip is arranged in the arc groove.

10. The fixed-rail rotor pump according to claim 2, wherein each cylinder end-cover is provided with a rotor cooling mouth interconnected with the fixed rail and the plurality of piston grooves.

11. The fixed-rail rotor pump according to claim 1, wherein the cylinder is a cylindrical cylinder, the fixed rail is a columniform fixed rail;

the rotor shaft and the columniform fixed rail are formed into an integrated structure;

the columniform fixed rail eccentrically penetrates through the cylinder end-covers and the rotor, the cylinder end-cover corresponding to an end face of the columniform fixed rail is provided with a circular groove, the columniform fixed rail and the cylindrical cylinder are concentric;

the rotor is a cylindrical rotor, the cylindrical rotor is eccentrically arranged in the cylindrical cylinder;

a value of eccentricity between the cylindrical rotor and the cylindrical cylinder is equal to a value of radius difference between the cylindrical rotor and the cylindrical cylinder;

the cylindrical rotor comprises a rotor ring and a plurality of fixed rings fixed at two ends of the rotor ring, wherein the plurality of fixed rings extend to the insides of a plurality of circular grooves on the cylinder end-covers, an internal surface of each fixed ring is provided with an internal ring tooth, an external ring tooth is correspondingly arranged on an external surface of the columniform fixed rail, the internal ring tooth is meshed with the external ring tooth;

the shaft center of the piston rotating-shaft is located at the circumferential line of the same radius concentric with the cylindrical rotor, the distance between the shaft center of the piston rotating-shaft and an outer circumferential line of an annular groove is less than half of a radius difference between the annular groove and the columniform rotor; and each piston carries out a circular motion around the columniform fixed rail.

12. A fixed-rail rotor pump combined supercharging internal-combustion engine comprising:

at least two fixed-rail rotor pumps in claim 1, and wherein the at least two fixed rail rotor pumps are arranged on a same rotor shaft through combined connection.

13. The fixed-rail rotor pump combined supercharging internal-combustion engine according to claim 12, wherein the fixed-rail rotor pump combined supercharging internal-combustion engine comprises one fixed-rail rotor pump used as the compressor and one fixed-rail rotor pump used as the internal-combustion engine through fixed connection; or the fixed-rail rotor pump combined supercharging internal-combustion engine comprises one fixed-rail rotor pump used as the compressor and two fixed-rail rotor pumps used as the internal-combustion engines through fixed connection; or the fixed-rail rotor pump combined supercharging internal-combustion engine comprises one fixed-rail rotor pump used as the internal-combustion engine and two fixed-rail rotor pumps used as the compressors through fixed connection.

14. The fixed-rail rotor pump combined supercharging internal-combustion engine according to claim 13, wherein the rotor, between adjacent fan-shaped pistons, of the fixed-rail rotor pump used as the internal-combustion engine is provided with a combustion groove.

15. The fixed-rail rotor pump combined supercharging internal-combustion engine according to claim 12, wherein the cylinder end-covers of adjacent two fixed-rail rotor pumps are formed into an integrated structure, so that a shared cylinder end-cover is formed.

16. The fixed-rail rotor pump combined supercharging internal-combustion engine according to claim 15, wherein the shared cylinder end-cover of adjacent two fixed-rail rotor pumps is provided with at least a cylindrical air jet micro-hole;

the air jet micro-hole is used as an outlet of the fixed-rail rotor pump used as the compressor and used as an inlet of the fixed-rail rotor pump used as the internal-combustion engine; and the cylinder of the fixed-rail rotor pump used as the internal-combustion engine and near the air jet micro-hole is provided with a fuel nozzle and at least a spark plug.

17. The fixed-rail rotor pump combined supercharging internal-combustion engine according to claim 12, wherein when the radiuses of adjacent cylinders are same, the axial length of the fixed-rail rotor pump used as the compressor is greater than the axial length of the fixed-rail rotor pump used as the internal-combustion engine, so that the cylinder volume of the fixed-rail rotor pump used as the compressor is greater than the cylinder volume of the fixed-rail rotor pump used as the internal-combustion engine.

18. The fixed-rail rotor pump combined supercharging internal-combustion engine according to claim 12, wherein bounded by a cylinder diameter line passing through a tangent point between the inner wall of the cylinder and the rotor;

a deviation angle is radially arranged between the cylinders of adjacent two cylindrical fixed-rail rotor pumps; and the deviation angle is not greater than 60 DEG.

* * * * *